United States Patent [19]

Kidder et al.

[11] Patent Number: 4,858,885

[45] Date of Patent: Aug. 22, 1989

[54] ANTI-BOUNCE LOGIC FOR CRITICAL LOADS

[75] Inventors: Kenneth B. Kidder, Coon Rapids; William R. Landis, Bloomington; Paul B. Patton, Rockford, all of Minn.

[73] Assignee: Honeywell Inc., Minneapolis, Minn.

[21] Appl. No.: 206,777

[22] Filed: Jun. 15, 1988

[51] Int. Cl.[4] ..... F23N 5/24

[52] U.S. Cl. ..... 251/129.01; 431/66; 431/18

[58] Field of Search ..... 251/129.01; 431/66, 431/18

[56] References Cited

U.S. PATENT DOCUMENTS

| | | | |
|---|---|---|---|
| 4,185,210 | 1/1980 | Zuk | 307/232 |
| 4,316,245 | 2/1982 | Luu et al. | 364/200 |
| 4,323,342 | 4/1982 | Sommers, Jr. et al. | 431/66 |
| 4,411,385 | 10/1983 | Lamkewitz | 237/2 A |
| 4,549,094 | 10/1985 | Floyd | 307/247 A |
| 4,575,333 | 3/1986 | Bryant | 431/18 |
| 4,626,708 | 12/1986 | Cooper | 307/441 |
| 4,634,367 | 1/1987 | Kasada | 431/29 |
| 4,695,246 | 9/1987 | Beilfuss et al. | 431/31 |
| 4,713,564 | 12/1987 | Kimball et al. | 307/542.1 |

*Primary Examiner*—Arnold Rosenthal
*Attorney, Agent, or Firm*—Alfred N. Feldman

[57] ABSTRACT

An anti-bounce system for control of critical loads is provided. A control system contains two subsystems. The first subsystem functions for normal control of the critical loads, but has a relatively long information processing time. This long time might prevent the system from controlling the loads in a safe manner. The system has a second subsystem that has a very rapid processing time. Both of the subsystems are connected to the load by coupling means to monitor as a feedback signal the exact state of the loads. The second subsystem overrides the first, and disconnects power whenever there has been an interruption of power for a short period of time.

14 Claims, 2 Drawing Sheets

ANTI-BOUNCE LOGIC FOR CRITICAL LOADS

BACKGROUND OF THE INVENTION

There are many types of operating systems that control loads of a critical nature. During an operating sequence for a system, certain loads may be energized, while other loads may be deenergized. Any unintentional change in state of a critical load due to momentary power changes within the system may be very undesirable. They may be undesirable from a point of view of overall physical safety, as well as undesirable from a standpoint of a possibility that economic damage may occur. It is desirable for the associated control system to respond as quickly as possible to any momentary changes in energization in order to properly react to avoid both physical damage which may be injurious to people or equipment, and to losses of equipment or product to avoid economic damage.

In recent years it has become common to provide control systems with microcomputers as the primary control or "brain" for the system. As microcomputers become more and more powerful, they are capable of monitoring and doing more work at a financially justifiable cost. As such, microcomputers take on very sophisticated control and safety functions. As microcomputers are required to do more and more work, the time that it takes them to process a signal increases. This increase in processing time may reach a point where the overall control system may be unable to respond to momentary changes in power within the system in a safe way, at least as far as certain critical loads are concerned.

An example of a system that has critical loads and microcomputer control is a fuel burner or flame safeguard control system. One type of critical load in this type of system is the fuel valve that supplies fuel to a burner. If the fuel valve is being controlled by a microcomputer controlled system that has a delay to process control data, a delay of a few hundreds of milliseconds can occur. This is a sufficiently long period of time for improper energization of a fuel valve. More specifically, if a fuel burner is in operation and momentarily has a power loss due to a line power loss, a momentary limit switch action, a poor solder connection, or any other cause, the fuel valve will start to close. If the fuel valve is then re-energized, fuel again starts flowing into the fuel burner, but the flame may have started to go out. A larger than normal amount of unburnt fuel accumulates. When it does reignite due to contact with a flame or a hot refractory, a "puff-back" or explosion occurs as this excess fuel burns. The severity of this explosion can be minor, but it can cause damage and certainly a hazard to the equipment, as well as, any personnel in the vicinity of the equipment. If the control system is properly designed, the system will note that the fuel valve has cycled and will take appropriate action, but the damage due to the momentary cycling of the fuel valve will have already taken place by this time.

It is thus apparent that some unsafe conditions can exist where a momentary operation of a critical load is caused by any of a number of different kinds of events, and with a control system that is too slow to respond in a safe manner. In the example given above, a safe control function would be to keep the fuel valve deenergized once it is momentarily deenergized. This would prevent any further fuel from entering a hot combustion chamber. This might mean a shut down of the system, but at least it would be a safe shut down of the system.

SUMMARY OF THE INVENTION

The present invention utilizes a control system that has two subsystems. The embodiment that will be specifically disclosed is a microcomputer controlled system, but it is possible to build a comparable system in discrete configurations, and also by using conventional electromechanical components. The control system utilizes a first subsystem that does the normal control logic for the system and may have a significant delay time. The second subsystem that works with the main system is a very rapid anti-bounce control logic system. Both of the subsystems are appropriately coupled to the power conductors of the critical loads.

Upon the system experiencing a momentary power loss, such as a line voltage loss, a momentary limit control operation, an intermittent connection, or similar occurrence, this event is coupled immediately to the second subsystem and this subsystem takes over or overrides the first subsystem that would normally respond to the event after a delay. The second subsystem reacts almost instantaneously, deenergizing the lines to the critical loads, and thereby eliminating the possibility that the critical load will be re-energized. The first subsystem, containing the normal control logic for the system, recognizes that the system has been shut down and keeps the system shut down thereby requiring a normal restart after appropriate service, if that is necessary.

In the example given above, the present invention is applied to a fuel burner control system or flame safeguard system. A critical load would be a fuel valve, and the power to the fuel valve is monitored by a coupling arrangement that supplies a feedback signal to a microcomputer based system. The system has the first subsystem for normal logic control, while the second subsystem is provided as an immediate response in the event of a power interruption when none should exist. The second subsystem reacts through a drive relay to open contacts that deenergizes power to the fuel valve, and the system shuts down in a safe manner. The logic in the microcomputer will tell a service person or operator at the fuel burner that a problem has occurred, and in modern equipment, will annunciate where and what type of problem is involved.

In accordance with the present invention, there is provided an anti-bounce system adapted to be connected to one or more critical loads to control and monitor the state of said loads, including: a control system adapted to control operating power to at least one critical load through load control means; said control system further including at least two subsystems for monitoring and controlling said critical load; a first of said subsystems for normal control of said critical load with said first subsystem having a normal signal processing time of such a length as to create a potential problem upon momentary failures of said operating power to said critical load which results in momentary change in state of said load; load control monitoring means having connection means connected to said load and said first subsystems to provide said first subsystem with feedback signal means to allow said first subsystem to monitor said load; a second of said subsystems for rapid control of said critical load with said second subsystem having a rapid signal processing time of such a length as to be able to rapidly control said load in the event of said momentary change in state of said load; and said load control monitoring means having further connection means connected to said second subsystem to allow said second subsystem to rapidly and safely control said critical load by operation of said load control means upon said momentary failure of said operating power to said critical load.

DESCRIPTION OF THE PREFERRED EMBODIMENT

Figure 1:
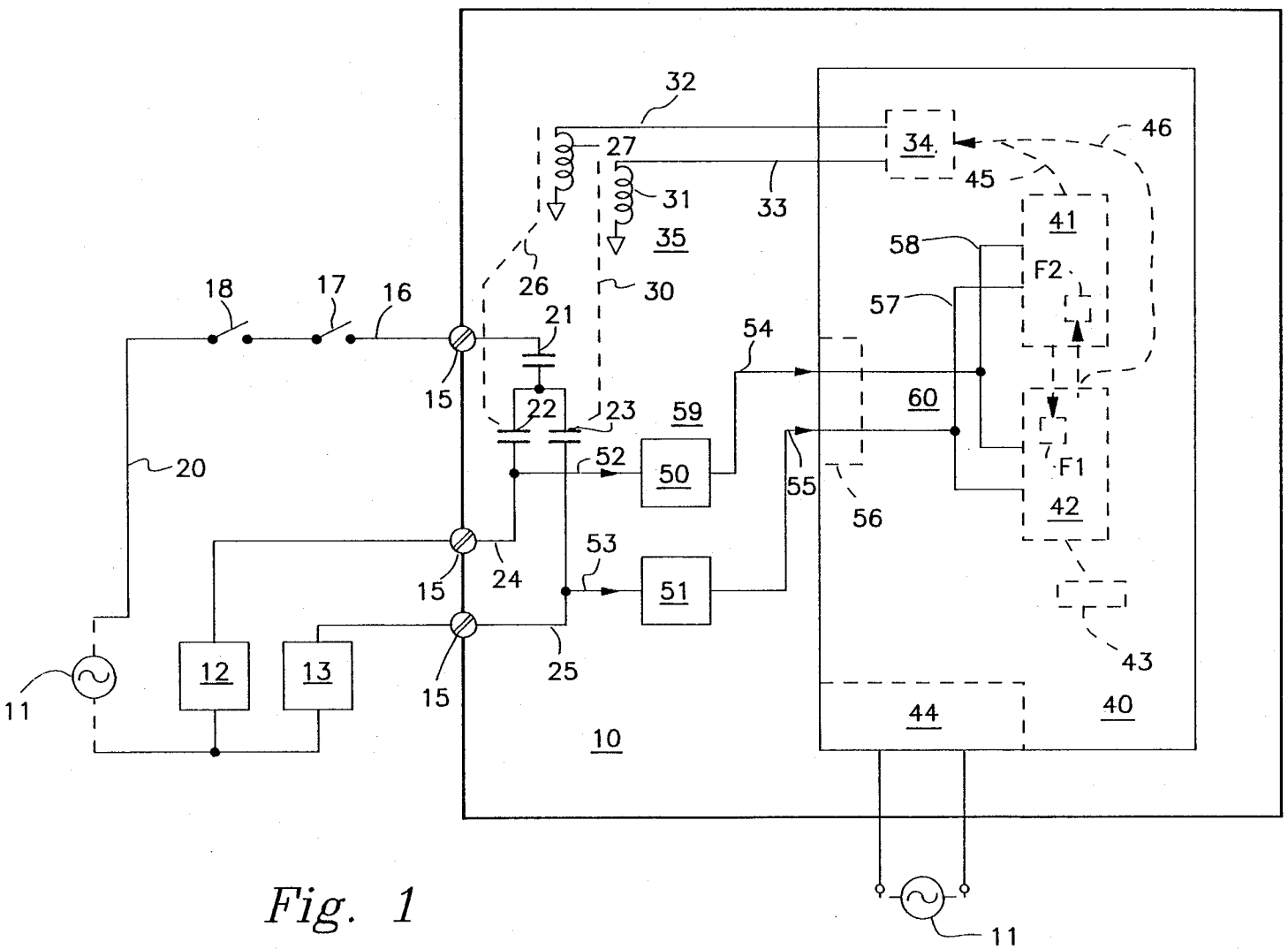
FIG. 1 is a partial block diagram of a fuel burner control system.

In FIG. 1 there is disclosed a partial diagram of a system that will be described as part of a fuel burner control system. An anti-bounce system 10 is generally disclosed to control electric power 11 to a pair of fuel valve means 12 and 13. The same power source 11 also supplies power to the anti-bounce control system 10.

The fuel valve means 12 and 13 are critical loads. During operation of a fuel burner, a momentary closing of a fuel valve can cause the existing flame to either decrease in intensity or go out. The reopening of that fuel valve after a momentary closing, can create serious safety problems. When fuel flow into a burner is interrupted, it is apparent that the normal flame either goes out or decreases in intensity. The reopening of the fuel valve then introduces a larger than normal amount of unburnt fuel and this fuel accumulates. If the main flame had not completely extinguished, or if a sufficiently hot refractory exists, the fuel that is inappropriately introduced into the fuel burner begins to burn in the form of a minor explosion or "puff-back". While this normally is a minor event, it can cause damage to the equipment, and in severe cases cause an explosion that can be hazardous to operators or associated equipment. It is desirable that once a critical load changes state, that it remain in the changed state and not be allowed to cycle back to its normal or previous state.

The present anti-bounce system 10 has a plurality of terminals 5, three of which are shown. The fuel valve means 12 and 13 are connected to two of the terminals, while a return or load energizing line 16 is shown connected to the third terminal 15. The line 16 is connected through a pair of limit switches 17 and 18 to a conductor 20 to the source of power 11.

Within the anti-bounce system 10 are a series of relay contacts 21, 22, and 23. The relay contact 21 can be for any overall control function of the fuel valve means 12 and 13, while contact 22 is for direct control of fuel valve means 12, While contact 23 is for direct control of fuel valve means 13. The contacts 22 and 23 are connected by conductors 24 and 25 to the appropriate terminals 15 for the fuel valve mean 12 and 13.

It can be readily understood that if the contact 21 was closed, than either of the fuel valve means 12 or 13 can be operated by the closing of the appropriate contacts 22 or 23. The contact 22 is controlled at 26 from a relay 27, while the contact 23 is controlled at 30 from a relay 31. The relay 27 is connected by conductor 32 to a relay drive circuit means 34. The relay 31 is also connected by a conductor 33 to the relay drive circuit means 34. The contacts 22 and 23, the relays 27 and 31 along with the relay drive circuit means 34 forms a load control means 35 for the system.

Contained within the anti-bounce system 10 is a microcomputer operated control system 40. This control system contains a conventional microcomputer and two subsystems that are within the microcomputer. A first subsystem 41 is the subsystem for normal control logic in operating the relay drive means 34. A second subsystem 4 is disclosed which is the anti-bounce control logic means for this system. The normal control logic means 41 or first subsystem, does all of the normal processing of information which determines whether the fuel valve means 12 or 13 should be on and if so, which should be energized by the operation of the relays 27 and/or 31. Due to the many tasks that the first subsystem 41 must perform, the subsystem may have a processing time that runs into the hundreds of milliseconds. This is a rather long period of time when considered in a time frame of mis-operation of either of the fuel valve means 12 or 13. A couple of hundred milliseconds failure to properly operate the fuel valve means 12 or 13 can create a hazardous situation. To overcome this problem, the second subsystem 42 has been provided which has the sole purpose of controlling in the event of a momentary interruption of power to the fuel valve means. This momentary interruption is being referred to as "bounce" within the present system. This term generally refers to the time of unsteady contact closure to an electromechanic device, such as a relay, or solenoid operated valve during its transition from one contact state to another Subsystem 42 is connected to an appropriate timer 43 that runs within the system 40. This timer is used to control the of response of subsystem 42 when power to the loads is interrupted. Also contained within the system 40 is a power interruption bridging means The power interruption bridging means 44 can be as a battery backup type of system, or as a power supply of a direct current nature that rather large filter capacitors. The object of the power interruption bridging means 40 is to supply the control system 40 with sufficient power to a momentary line voltage failure and allow the system safely shut down. It also allows sufficient time the system in the safe shut down mode to properly any data in appropriate nonvolatile memories within microcomputer that forms the heart of the control 40. Those functions are incidental to the present but should be understood in order to understand the operation of the invention.

Each of the subsystems 41 and 42 has a computer flag located in the other subsystem. The first subsystem 41 has a flag F1 which tells the second subsystem 42 the state of operation of the first subsystem 41. The second subsystem 42 has a flag F2 in the first subsystem to advise the first subsystem of the operation of the second subsystem. By means of an output circuit means 45, the first subsystem 41 is capable of operating the relay drive means 34, while an output circuit means 46 is disclosed from the second subsystem 42 which bypasses the first subsystem 41 and directly controls the relay drive means 34, when necessary.

The system is completed by a pair of opto-coupler means 50 and 51. The opto-coupler means 50 is connected by conductor 52 the conductor 24 thereby monitoring the power to the fuel valve means 12. The opto-coupler means 51 is connected by a conductor 53 to the conductor 25 to monitor the power supplied to the fuel valve means 13. Each of the opto-coupler means 50 and 51 has output conductors 54 and 55 that supply signals to the control system 40 through a signal conditioning means 56. The signal conditioning means 56 is used to appropriately transmit the outputs of the opto-coupler means 50 and 51 to a pair of conductors 57 and 58. This could be either hardware or software. In the present device, software is used to suppress momentary glitches while allowing real signal changes to go through. The conductors 57 and 58 connect into both of the subsystems 41 and 42 appraise those subsystems of the state of energization the fuel valve means 12 and 13 by monitoring the power on the conductors 24 and 25.

In order to better understand and treat the subject, certain of the components have been grouped into specific means. The relays 27 and 31 along with their contacts, conductors and the relay drive means 34 can be considered as the load control means 35. The output of the relay contacts 22 and 23, the opto-coupler means 50 and 51, the signal conditioning circuit 56 and the related interconnected circuitry is the load control monitoring means 59. The output of the signal conditioning means which supplies a signal to the subsystems 41 and 42 generally is the feedback signal means 60.

OPERATION OF FIG. 1

The present system is considered to be part of a burner control system, and as such, the limit switches 17 and 18 would normally be closed. If the control system 40 were functioning with the burner in an operating mode, the first subsystem 41 would control the relay drive means 34 and the load control means 35 to energize one or both of the relays 27 or 31. Assume that relay 27 is energized closing contact 22 thereby having the fuel valve means 12 in an energized state. The load control monitoring means 59 provides a feedback signal through the feedback signal means 60 to the control system 40 with both of the subsystems 41 and 42 receiving input signals that the conductor 24 is energized and conductor 25 is deenergized.

In the normal state, the logic flag F1 is turned on just after the subsystem 41 energizes one of the relays. In this case relay 27. The flag F1 is left on until just before the relay 27 is to be turned off as part of the normal operation of control system 40. With this arrangement, the logic in the subsystem 42 is enabled only during the time when one of the valve means 12 or 13 should be on.

When enabled by the logic flag F1, the anti-bounce control logic means or second subsystem 42 monitors the feedback means 60 through the opto-coupler means 51 and 52 verifying that the commanded state of the relays actually exist. If a conductor that is supposed to be energized indicates that it is not, then the anti-bounce control logic means or second subsystem 42 starts timer 43 to measure amount of "off" time. The time value used is typically chosen to be about two line cycles (32 milliseconds), and which is slightly less than the response time of a solenoid operated fuel valve means which can be as fast as 40 milliseconds. In any case, it is not the momentary closure of the fuel valve that is to be prevented, but rather the closure for a long enough time to cause a problem, and yet, too short of a time to be handled using the normal control logic or first subsystem 41.

If the second subsystem 42 does detect an abnormal deenergization of conductors 24 or 25 connected to one of the fuel valve means 12 or 13, and if this deenergization persists for a predetermined time, then the second subsystem 42 preemptively and immediately commands the relay drive means 34 to turn off all of the safety critical loads and it further sets the flag F2 to inform the first subsystem 41 that this has occurred. With this setting, a safety shut down or some other recovery procedure is initiated within the operation of the routines of the microcomputer contained in the control system 40. Thus, the hazardous condition to be avoided is prevented.

The anti-bounce control logic means or second subsystem 42 prevents an unsafe condition by continuously monitoring the signals from safety critical loads, independently measuring the amount of time that they are deenergized, and preemptively turning off the drive to the loads if the amount of time is excessive.

Figure 2:
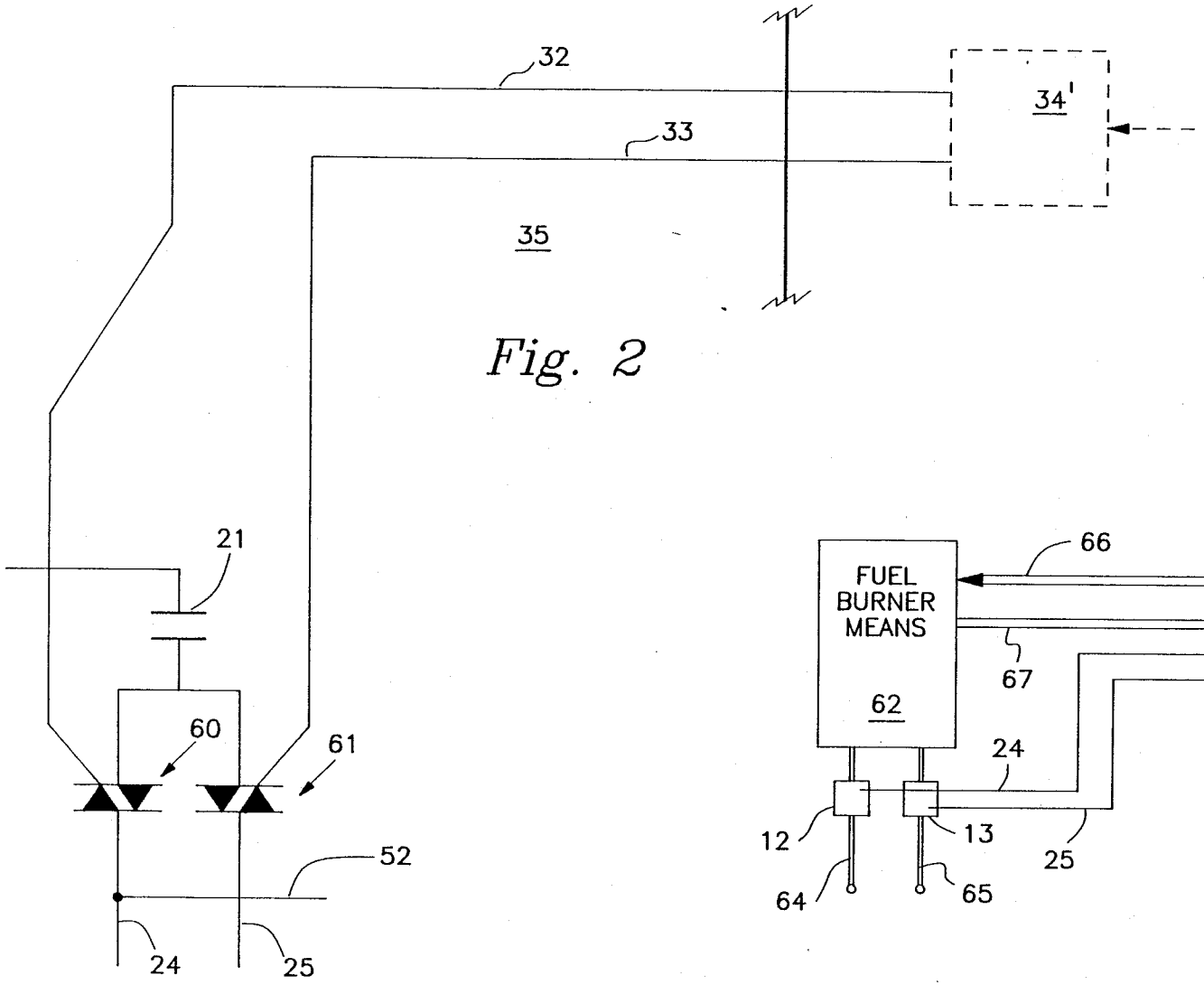
FIG. 2 is a partial circuit showing a second embodiment.

In FIG. 2 a load control means 35' is disclosed wherein drive means 34' is used to supply power on conductors 32 and 33 to a pair of triacs 60 and 61. The triacs 60 and 61 are operated as direct substitutes for the relay contacts 22 and 23 and their operation is deemed substantially obvious. Instead of driving relays 27 and 31, the circuit of FIG. 2 relies on solid state switch means 60 and 61 in the form of the triacs to control energy to the loads. The balance of the control system is unchanged.

Figure 3:
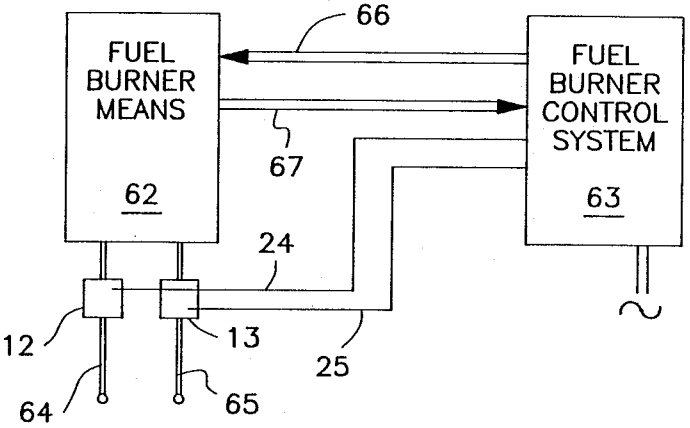
FIG. 3 is a general block diagram of a fuel burner control system.

In FIG. 3 a very general block diagram of a fuel burner means 62 is disclosed connected to a fuel burner control system 63 that is functionally equivalent to the anti-bounce system 10 and control system 40 of FIG. 1. The fuel valve means 12 and 13 are controlled from the conductors 24 and 25, and data buses 66 and 67 are provided to interconnect all of the limit switches, control functions and equipment normally found in a fuel burner control means and its associated fuel burner control system.

The system disclosed specifically in FIG. 1 can respond to a number of different types of interruptions of power to the fuel valve means 12 or 13. It is not uncommon in this type of system for a limit switch, such as 17 or to momentarily open or close. Further, it is not uncommon in commercial environments for there to be momentary losses of line voltage. Also, it has been found that there are momentary losses of control power due to bad contacts or solder joints. The present anti-bounce system 10 is capable of responding to any of these by having the second subsystem 42 act as anti-bounce control logic means that has a very rapid response time compared to the normal control logic means or first subsystem 41. The present arrangement could be applied to any type of system that has critical loads, and is not limited to the flame safeguard or fuel burner control environment in which the invention was specifically disclosed. Also, it is obvious that many different types of implementations of the control system logic would be applicable, and the inventors wish to be limited in the scope of their invention solely by the scope of the appended claims.

The embodiments of an invention in which an exclusive property or right is claimed are defined as follows:

1. An anti-bounce system adapted to be connected to one or more critical loads to control and monitor the state of said loads, including: a control system adapted to control operating power to at least one critical load through load control means; said control system further including at least two subsystems for monitoring and controlling said critical load; a first of said subsystems for normal control of said critical load with said first subsystem having a normal signal processing time of such a length as to create a potential problem upon momentary failures of said operating power to said critical load which results in momentary change in state of said load; load control monitoring means having connection means connected to said load and said first subsystems to provide said first subsystem with feedback signal means to allow said first subsystem to monitor said load; a second of said subsystems for rapid control of said critical load with said second subsystem having a rapid signal processing time of such a length as to be able to rapidly control said load in the event of said momentary change in state of said load; and said load control monitoring means having further connection means connected to said second subsystem to allow said second subsystem to rapidly and safely control said critical load by operation of said load control means upon said momentary failure of said operating power to said critical load.

2. An anti-bounce system as claimed in claim 1 wherein said control system is a fuel burner control system; and said critical load is fuel valve means.

3. An anti-bounce system as claimed in claim 2 wherein said control system includes power interruption bridging means capable of powering said control system in the event of said operating power being briefly interrupted.

4. An anti-bounce system as claimed in claim 2 wherein said control system includes microcomputer means with said microcomputer means including said first subsystem having normal control logic means; and said microcomputer means further having said second subsystem including rapid control logic means.

5. An anti-bounce system as claimed in claim 4 wherein said load control monitoring means includes opto-coupling means connected to said fuel valve means.

6. An anti-bounce system as claimed in claim 5 wherein said opto-coupling means includes signal conditioning means to supply said control system with data representative of the state of energization of said fuel valve means.

7. An anti-bounce system as claimed in claim 6 wherein said load control means includes relay drive means connected to control fuel valve relay means; said fuel valve relay means having relay contact means connected to said operating power to supply energization through said relay contact means to said fuel valve means.

8. An anti-bounce system as claimed in claim 7 wherein said two subsystems each include data flag means with first data flag means in said second subsystem with said flag means controlled by said first subsystem; and second data flag means in said first subsystem with said second data flag means controlled by said second subsystem.

9. An anti-bounce system as claimed in claim 6 wherein said load control means includes solid state switch drive means connected to control solid state fuel valve switch means; said solid state fuel valve switch means connected to supply power from said operating power to said fuel valve means.

10. An anti-bounce system as claimed in claim 9 wherein said solid state fuel valve switch means includes at least one triac.

11. An anti-bounce system as claimed in claim 9 wherein said two subsystems each include data flag means with first data flag means in said second subsystem with said flag means controlled by said first subsystem; and second data flag means in said first subsystem with said second data flag means controlled by said second subsystem.

12. An anti-bounce system as claimed in claim 11 wherein said solid state fuel valve switch means includes at least one triac.

13. An anti-bounce system as claimed in claim 8 wherein said control system includes power interruption bridging means capable of powering said control system in the event of said operating power being briefly interrupted.

14. An anti-bounce system as claimed in claim 11 wherein said control system includes power interruption bridging means capable of powering said control system in the event of said operating power being briefly interrupted.

* * * * *